US007581641B2

(12) United States Patent
Hassell et al.

(10) Patent No.: US 7,581,641 B2
(45) Date of Patent: Sep. 1, 2009

(54) PORTABLE STORAGE CONTAINER

(75) Inventors: Jon P. Hassell, Atlanta, GA (US); William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 379 days.

(21) Appl. No.: 11/109,485

(22) Filed: Apr. 18, 2005

(65) Prior Publication Data

US 2006/0231449 A1 Oct. 19, 2006

(51) Int. Cl.
*B65D 21/06* (2006.01)
*B65D 25/32* (2006.01)

(52) U.S. Cl. ..... 206/506; 220/764

(58) Field of Classification Search ..... 206/506, 206/505, 504, 519, 518, 516, 515, 507, 503, 206/821; 220/756, 770, 764, 605, 760, 752, 220/761, 23.86, 23.83, 762; *B65D 21/06*
See application file for complete search history.

(56) References Cited

U.S. PATENT DOCUMENTS

| | | | | | |
|---|---|---|---|---|---|
| 189,378 | A | * | 4/1877 | Niedringhaus et al. | 220/752 |
| 627,273 | A | * | 6/1899 | Seibert | 220/762 |
| 1,180,354 | A | * | 4/1916 | White | 220/762 |
| 1,219,969 | A | * | 3/1917 | Lowe | 220/756 |
| 2,029,746 | A | | 2/1936 | Tufts et al. | |
| 2,061,414 | A | | 11/1936 | Tufts et al. | |
| 2,134,875 | A | | 11/1938 | Henze | |
| 2,609,120 | A | | 9/1952 | Williams | |
| 3,220,603 | A | | 11/1965 | Bromley | |
| 3,323,673 | A | | 6/1967 | Cowan | |
| 3,951,265 | A | | 4/1976 | Carroll | |
| 4,109,791 | A | | 8/1978 | Clipson et al. | |
| 4,241,831 | A | | 12/1980 | Locatelli | |
| 4,247,004 | A | | 1/1981 | Bird | |
| 4,391,369 | A | | 7/1983 | Stahl et al. | |
| 4,423,813 | A | | 1/1984 | Kreeger et al. | |
| 4,466,541 | A | | 8/1984 | Tabler et al. | |
| 4,573,577 | A | | 3/1986 | Miller | |
| RE32,223 | E | | 8/1986 | Kreeger et al. | |
| 4,643,310 | A | | 2/1987 | Deaton et al. | |
| 4,759,451 | A | | 7/1988 | Apps | |
| 4,770,300 | A | | 9/1988 | Klein | |

(Continued)

FOREIGN PATENT DOCUMENTS

| | | |
|---|---|---|
| DE | 35 11 321 | 10/1986 |

(Continued)

OTHER PUBLICATIONS

United Kingdom Search Report and Opinion, Jun. 27, 2006.

(Continued)

*Primary Examiner*—Mickey Yu
*Assistant Examiner*—Robert J Hicks
(74) *Attorney, Agent, or Firm*—Carlson, Gaskey & Olds

(57) ABSTRACT

A portable storage container that both stacks and nests with similar containers includes a plurality of walls extending upwardly from a floor. At least one bail member is moveable between a plurality of positions for supporting the similar containers at varying heights. The bail member includes a support portion and two arms extending transversely from the support portion. A projection extends laterally from between axial ends of each arm.

13 Claims, 17 Drawing Sheets

U.S. PATENT DOCUMENTS

| | | | | |
|---|---|---|---|---|
| 4,848,578 | A | 7/1989 | Schafer | |
| 4,905,833 | A | 3/1990 | Kreeger et al. | |
| 4,947,992 | A | 8/1990 | Shafer | |
| 4,982,844 | A | 1/1991 | Madan et al. | |
| 5,083,666 | A | 1/1992 | Lam | |
| 5,445,425 | A * | 8/1995 | Lyver | 294/31.2 |
| 5,469,986 | A | 11/1995 | Jang | |
| 5,494,163 | A | 2/1996 | Apps | |
| 5,609,254 | A | 3/1997 | Loftus et al. | |
| 5,617,953 | A | 4/1997 | Cope | |
| D381,203 | S | 7/1997 | Ackermann | |
| D382,404 | S | 8/1997 | Cope | |
| 5,772,033 | A | 6/1998 | Loftus et al. | |
| 5,881,902 | A | 3/1999 | Ackermann | |
| 5,901,408 | A * | 5/1999 | Miller et al. | 15/339 |
| 5,924,572 | A | 7/1999 | Cope | |
| 6,059,114 | A | 5/2000 | Loftus | |
| D436,729 | S | 1/2001 | Aiken | |
| 6,938,772 | B2 | 9/2005 | Aiken et al. | |
| 7,014,043 | B2 | 3/2006 | Raghunathan et al. | |
| 7,017,745 | B2 | 3/2006 | Raghunathan | |
| 2002/0117420 | A1 * | 8/2002 | McDade | 206/505 |
| 2002/0179480 | A1 | 12/2002 | Raghunathan et al. | |
| 2003/0230510 | A1 | 12/2003 | Aiken et al. | |
| 2004/0245142 | A1 * | 12/2004 | Raghunathan | 206/506 |
| 2005/0224385 | A1 | 10/2005 | Hassell et al. | |
| 2005/0263423 | A1 | 12/2005 | Hassell et al. | |
| 2005/0263424 | A1 | 12/2005 | Hassell et al. | |
| 2006/0065567 | A1 * | 3/2006 | Hassell et al. | 206/506 |
| 2006/0096883 | A1 * | 5/2006 | Raghunathan et al. | 206/506 |
| 2006/0108372 | A1 | 5/2006 | Aiken et al. | |

FOREIGN PATENT DOCUMENTS

| | | | |
|---|---|---|---|
| DE | 35 21 894 | | 1/1987 |
| DE | 199 39 019 | A1 | 2/2001 |
| DE | 200 02 537 | U1 | 7/2001 |
| EP | 0 311 174 | A1 | 4/1989 |
| EP | 0 557 002 | A | 8/1993 |
| EP | 0 697 341 | A | 2/1996 |
| EP | 0697341 | A1 | 2/1996 |
| EP | 0926073 | A1 | 6/1999 |
| EP | 1170223 | | 1/2002 |
| EP | 1241105 | | 9/2002 |
| FR | 2 678 585 | | 1/1993 |
| GB | 2067167 | A * | 7/1981 |
| GB | 2 124 588 | A | 2/1984 |
| GB | 2 129 401 | | 5/1984 |
| GB | 2 137 167 | | 10/1984 |
| GB | 2 141 778 | | 1/1985 |
| GB | 2 171 980 | | 9/1986 |
| GB | 2 180 821 | | 4/1987 |
| GB | 2 209 737 | | 5/1989 |
| GB | 2296009 | | 6/1996 |
| GB | 2333285 | | 7/1999 |
| GB | 2340485 | | 2/2000 |
| GB | 2350350 | | 11/2000 |
| GB | 2373239 | | 9/2002 |
| GB | 2373240 | | 9/2002 |
| GB | 2 374 859 | A | 10/2002 |
| GB | 2425302 | | 10/2006 |
| GB | 2427606 | | 1/2007 |
| NL | 790 5105 | | 6/1979 |
| WO | WO 98/01352 | | 1/1998 |
| WO | WO/0027716 | | 5/2000 |
| WO | WO 00/51900 | | 9/2000 |
| WO | WO 00/66440 | | 11/2002 |
| WO | 2005100179 | | 10/2005 |
| WO | 2005115854 | | 12/2005 |
| WO | 2006036868 | | 4/2006 |

OTHER PUBLICATIONS

International Search Report, Oct. 31, 2005.
International Search Report, Aug. 24, 2005.
International Search Report, Feb. 13, 2006.

* cited by examiner

PORTABLE STORAGE CONTAINER

BACKGROUND OF THE INVENTION

The present invention relates generally to portable storage containers and more particularly to portable storage containers that provide the ability to select different nesting and stacking depths.

Portable storage containers that both stack and nest with similar containers are commonly used for transporting and storing goods. Nesting is typically achieved when an empty container receives a like container therein such that there is at least some overlap between the walls of the containers. The stacking feature is typically used when an occupied container has a like container supported thereon, such that the goods contained in the lower container are preferably not contacted or damaged by the upper container. Many containers use members (known as bail members) to achieve the stacking feature. Bail members may typically be positioned out of the way for purposes of nesting, but then moved to a stacking position for allowing containers to be stacked thereon.

The bail members in some containers are movable among three positions: a nesting position, a first stacking position and a second stacking position. In the nesting position, the bail members are out of the way and the upper container can substantially nest within the lower container. The bail members support containers in the first stacking position at a first distance from the floor, where the upper container is not substantially nested within the lower container. The bail members also can be moved to the second stacking position to support the upper container at a second distance from the floor, where the upper container is partially nested within the lower container.

SUMMARY OF THE INVENTION

A portable storage container that both stacks and nests with similar containers includes a plurality of walls extending upwardly from a floor. At least one bail member is moveable between a plurality of positions for supporting the similar containers at varying heights. The bail member includes a support portion pivotably connected to the container by arms at each end. The bail member includes at least one projection from the arm of the bail member. The projection contacts a support surface of one of the walls while the bail member pivots about the projection when moving from one position to another.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
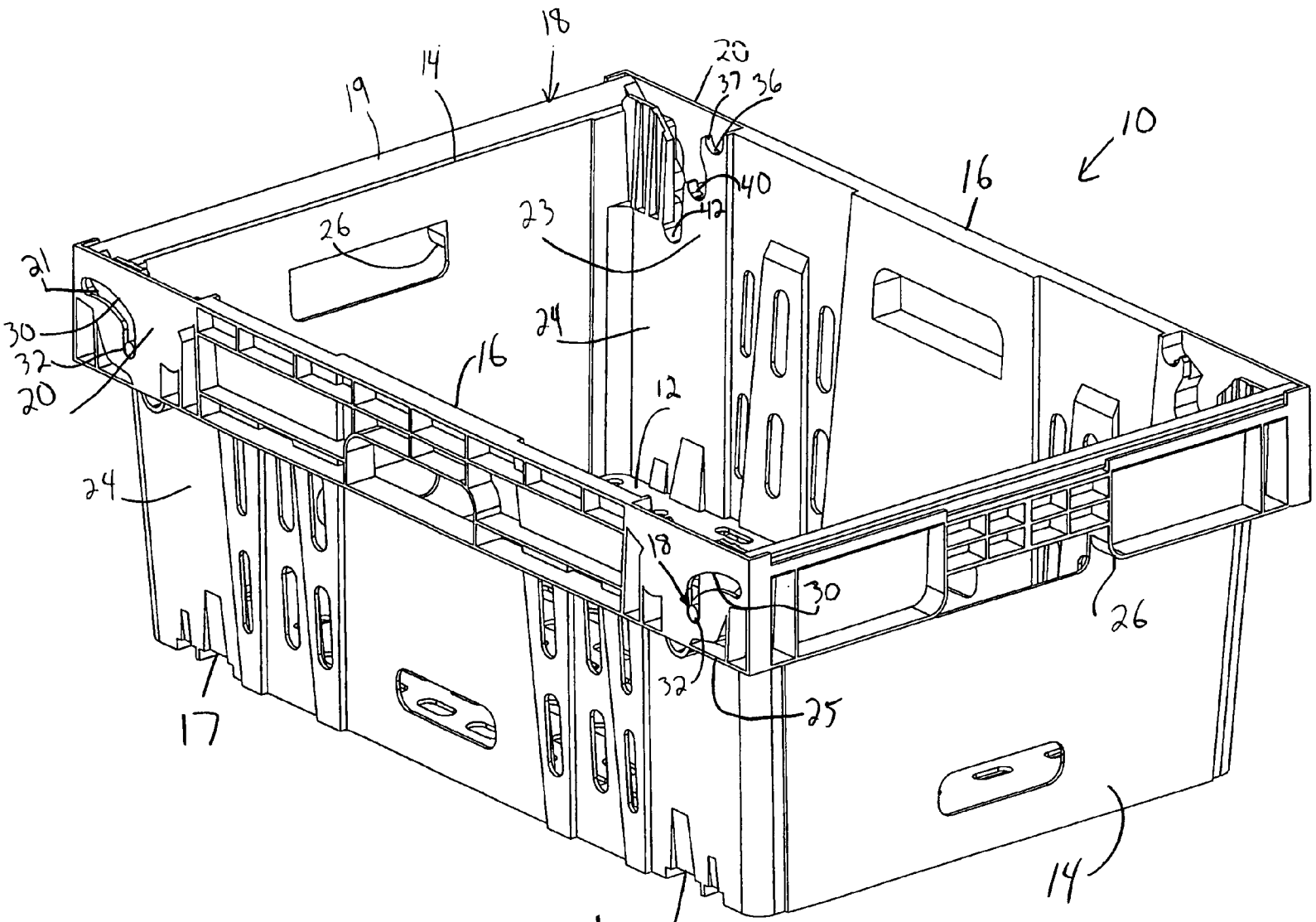
FIG. 1 is a perspective view of a container according to one embodiment of the present invention with the bail members in a low nest position.

A container 10 is shown in FIG. 1. The container 10 includes a floor 12 and a pair of opposed side walls 14 and a pair of opposed end walls 16. A pair of notches 17 are formed at the bottom of the end walls 16 and the floor 12. The notches 17 each define a channel which extends from one end wall 16 to the other.

Figure 2:
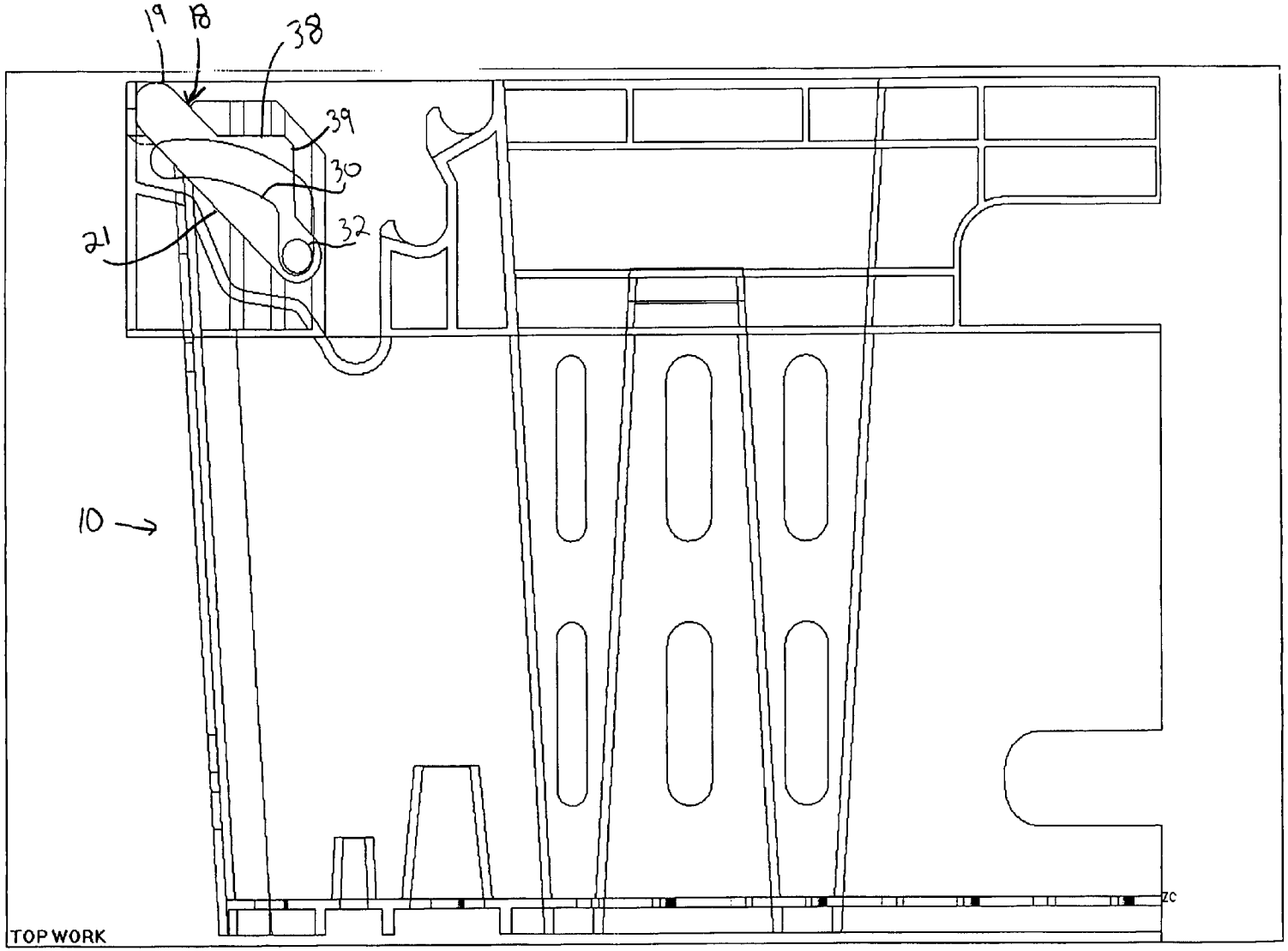
FIG. 2 is a partial side sectional view of the container of FIG. 1.

Two bail members 18 are each mounted to each end wall 16. While they may take a variety of shapes, bail members 18 are shown as molded plastic having a generally cylindrical support portion 19 that extends across the length of the container 10. Each bail member 18 includes a pair of arms 21 extending transversely from the support portion 19. As shown in FIG. 2, each arm 21 includes a lateral projection 38 that protrudes from a mid-point of the interior side of the arm 21. The lateral projection 38 may be any shape, such as generally triangular or pyramid-shaped as shown, and has an outer end 39, which in the embodiment shown, is the area near one corner of the triangle.

The end walls 16 each include an upper wall portion that has an outer wall portion 20 spaced from an inner wall portion 23. A lower wall portion 24 is generally aligned below the inner wall portion 23, such that the outer wall portion 20 forms a support or ledge 25 along the end wall 16. The side walls 14 similarly include ledges 26 protruding outwardly from the side walls 14 at a height even with the ledges 25 on the end walls 16.

The inner wall portion 23 includes an upper support rest 36 at a height above the floor 12 for supporting the bail member 18 at an upper stacking position. Each upper support rest 36 includes an upwardly open concave recess 37, which is a notch formed in the inner wall portion 23. The inner wall portion 23 further includes a middle support rest 40 for supporting the bail member 18 at a mid-level height, and a lower support rest 42, which is closer to the floor than the upper support rest 36, for supporting the bail member 18 at a lower stacking position.

Elongated pin openings 30 are formed in each outer wall portion 20 to trap pins 32 at the outer ends of the bail members 18. The pins 32 are slidable and pivotable within the pin openings 30, such that the bail members 18 can be moved to a plurality of positions and orientations. The pin openings each include a first portion that extends arcuately from an outer end inwardly and downwardly, and a second portion extending from the first portion downwardly to an inner end. The pins 32 are at the inner ends of the pin openings 30 in FIGS. 1-3.

Figure 3:
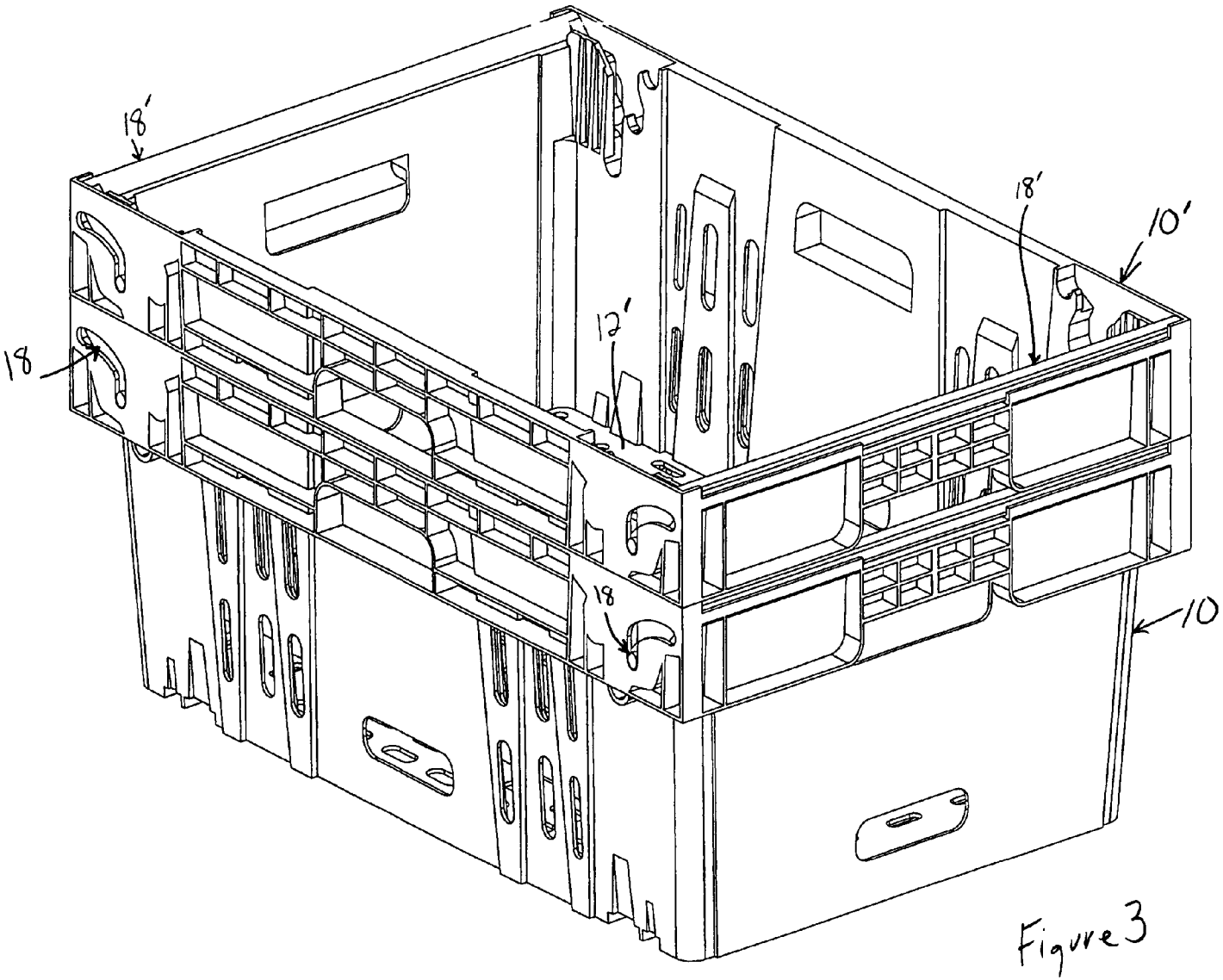
FIG. 3 shows the container of FIG. 1, with a similar container nested therein.

In FIGS. 1-3, the bail members 18 are in a nest position. The pins 32 of the bail members 18 are slid to an inner end of the pin opening 30 and the bail members 18 are pivoted to a downward position, as shown. In the nest position, the support portions 19 of the bail members 18 are positioned outwardly of the floor 12.

Referring to FIG. 3, in the nest position, a similar container 10' can be nested within the container 10, such that the floor 12' of the upper container 10' is not supported on the bail members 18. This position provides the most efficient storage of the containers 10, 10' when empty.

Figure 4:
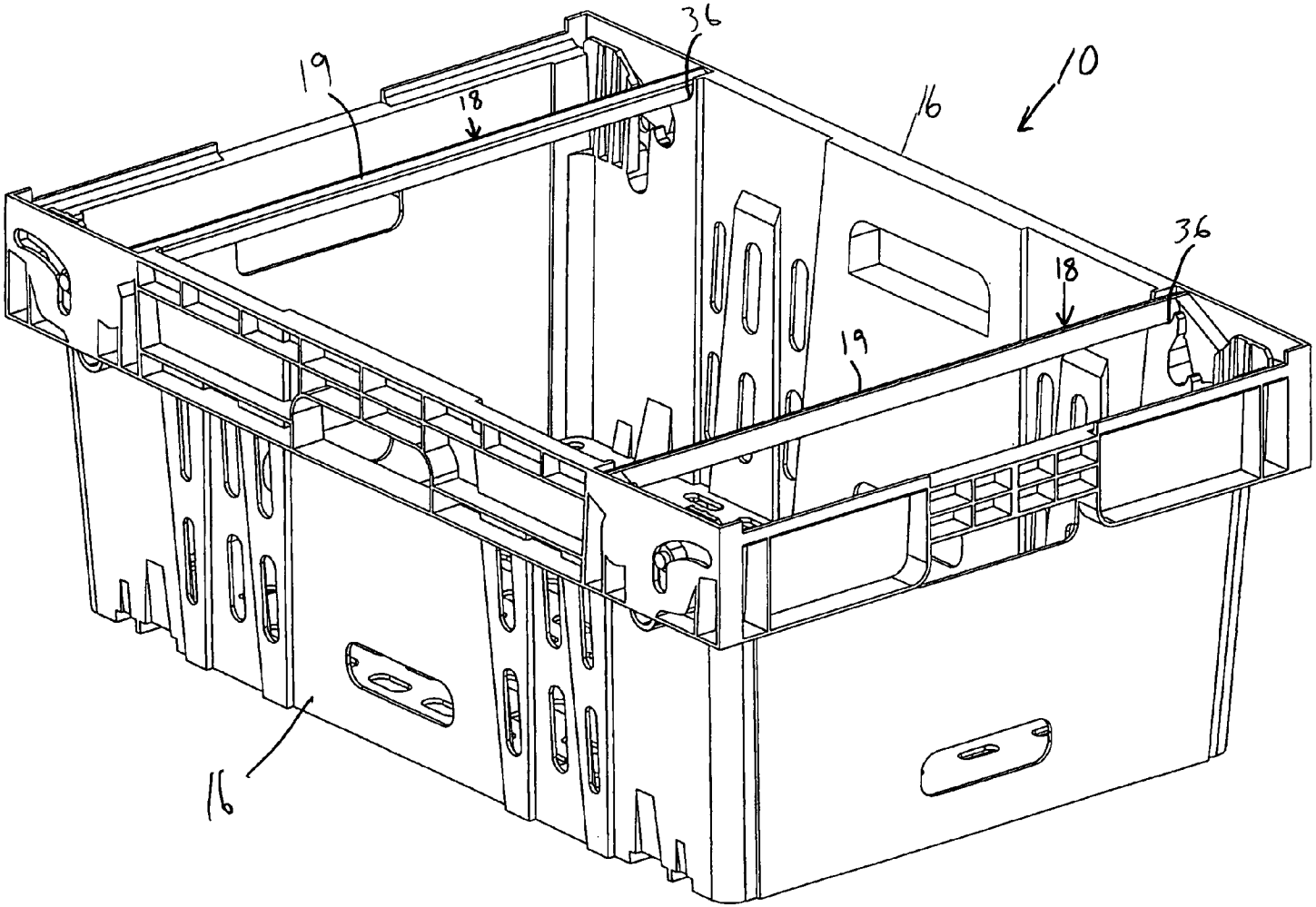
FIG. 4 is a perspective view of the container with the bail members in a high stacking position.
Figure 5:
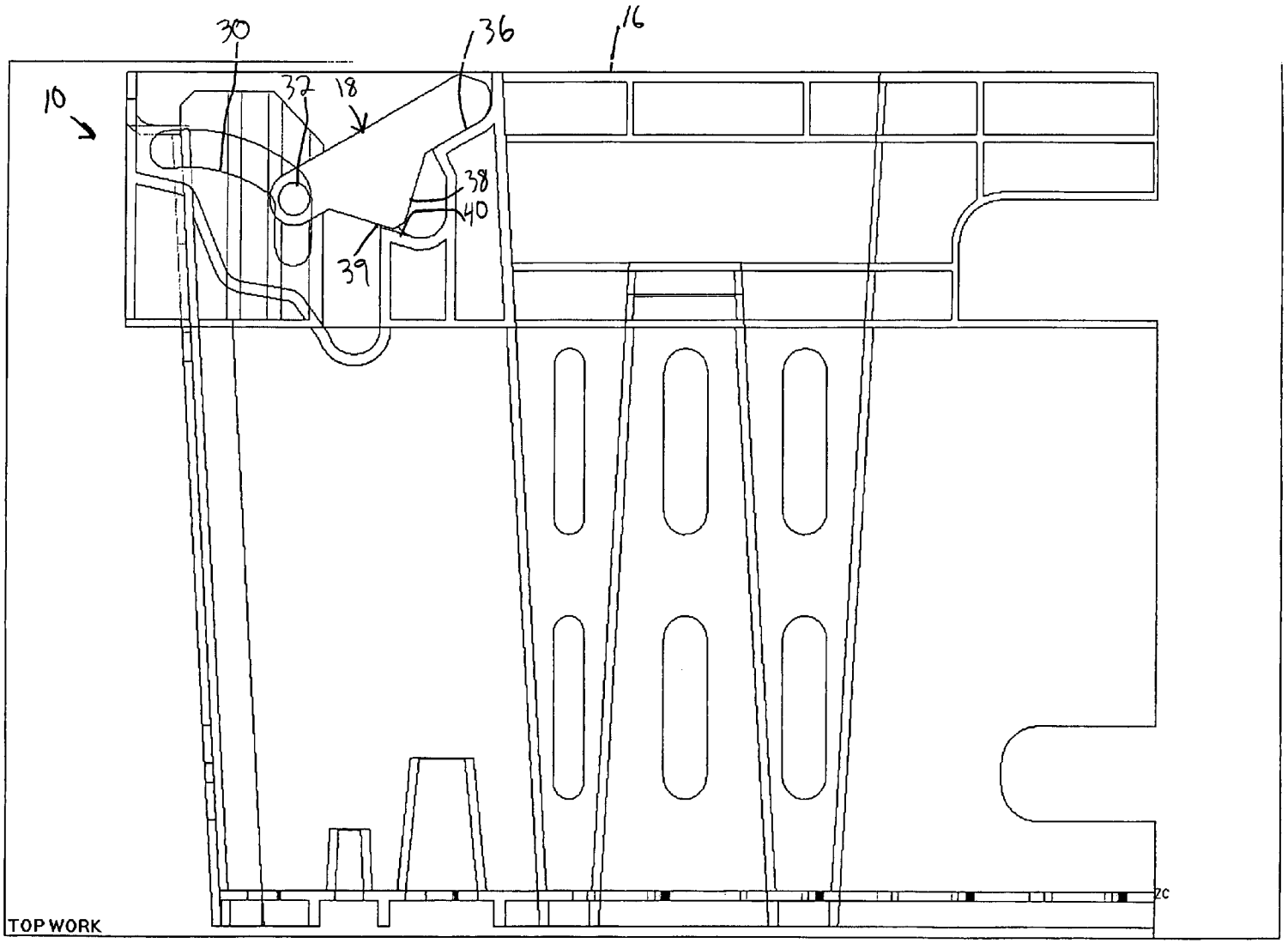
FIG. 5 is a partial side sectional view of the container of FIG. 4.
Figure 6:
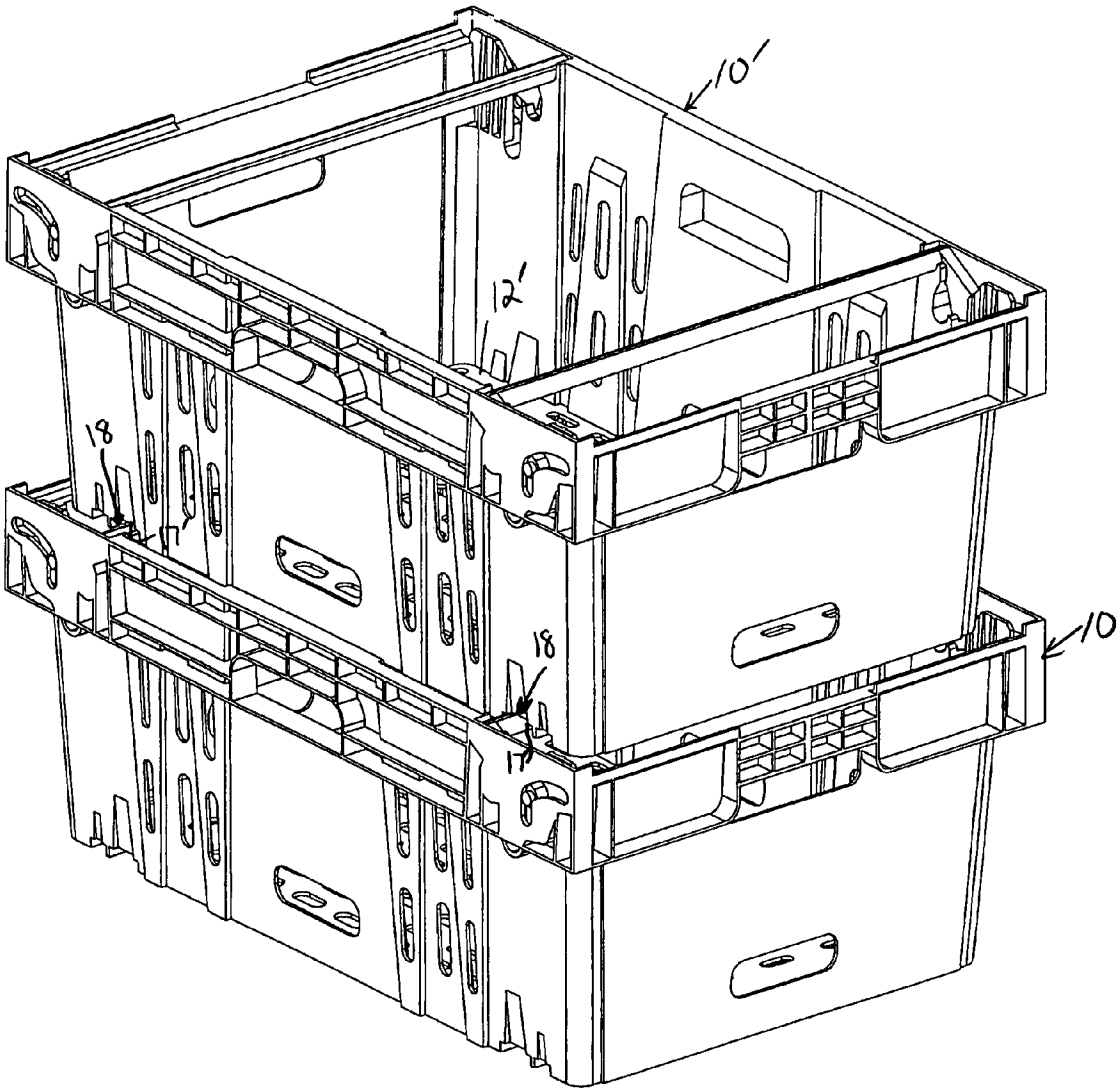
FIG. 6 shows the container of FIG. 4, with a similar container stacked thereon.

FIGS. 4-6 illustrate the container 10 in the high stacking position. As can be seen in FIG. 5, the lateral projection 38 of the arm 18 is supported on the middle rest 40 of the inner wall portion 23. The support portions 19 of the bail members 18 are supported by the upper rests 36. FIG. 6 shows the containers 10, 10' of FIG. 3 with the bail members 18 of the lower container 10 in the high stacking position. The support portions 19 of the bail member 18 of the lower container 10 is received in the notches 17' of the upper container 10' such that the floor 12' of the upper container 10' is supported by the bail members 18. This position provides the maximum storage capacity in the container 10 and transfers load to the bail members 18, thus keeping the weight of the upper container 10' off the contents of the lower container 10.

Figure 7:
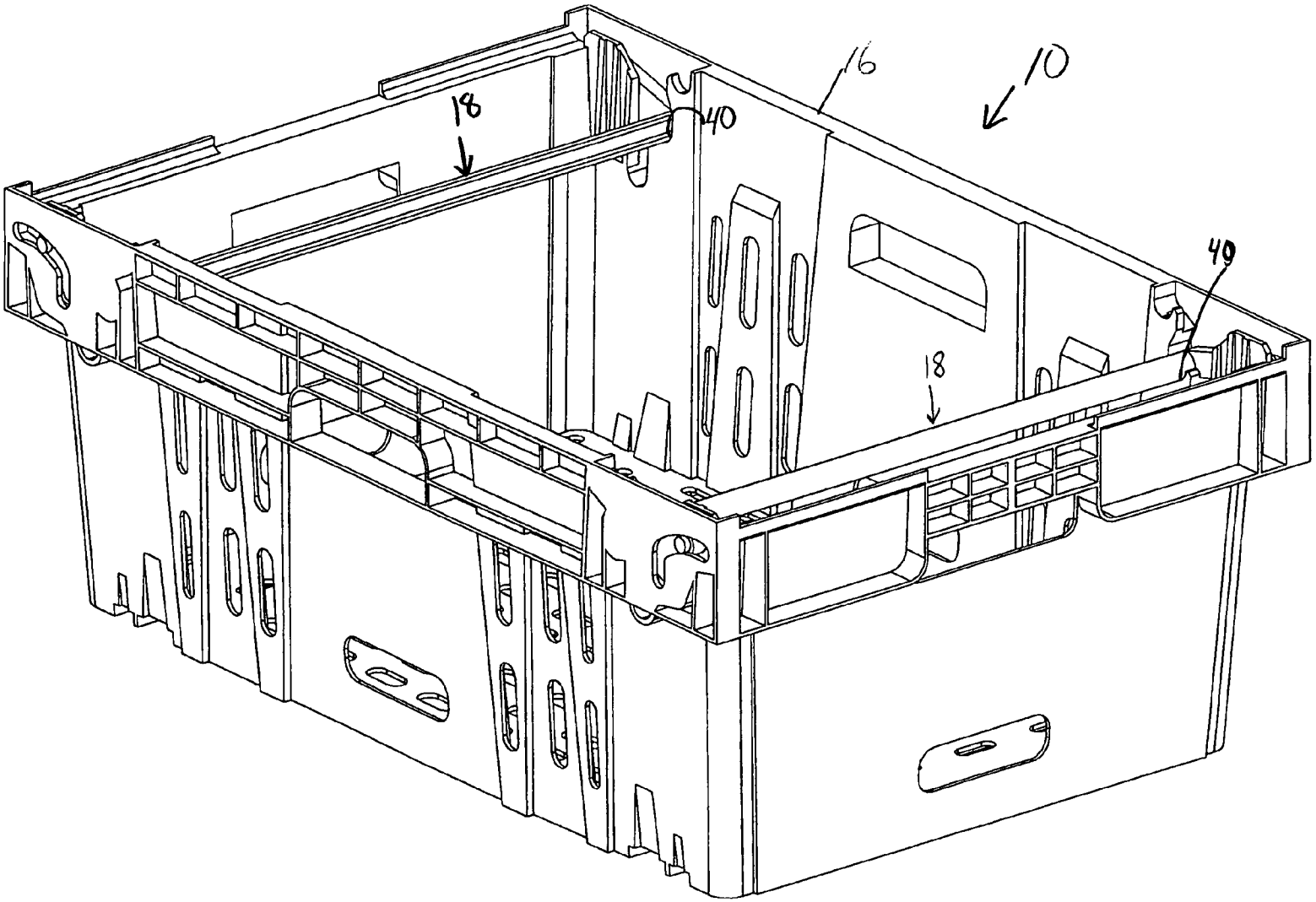
FIG. 7 is a perspective view of the container with the bail members in a middle stacking position.
Figure 8:
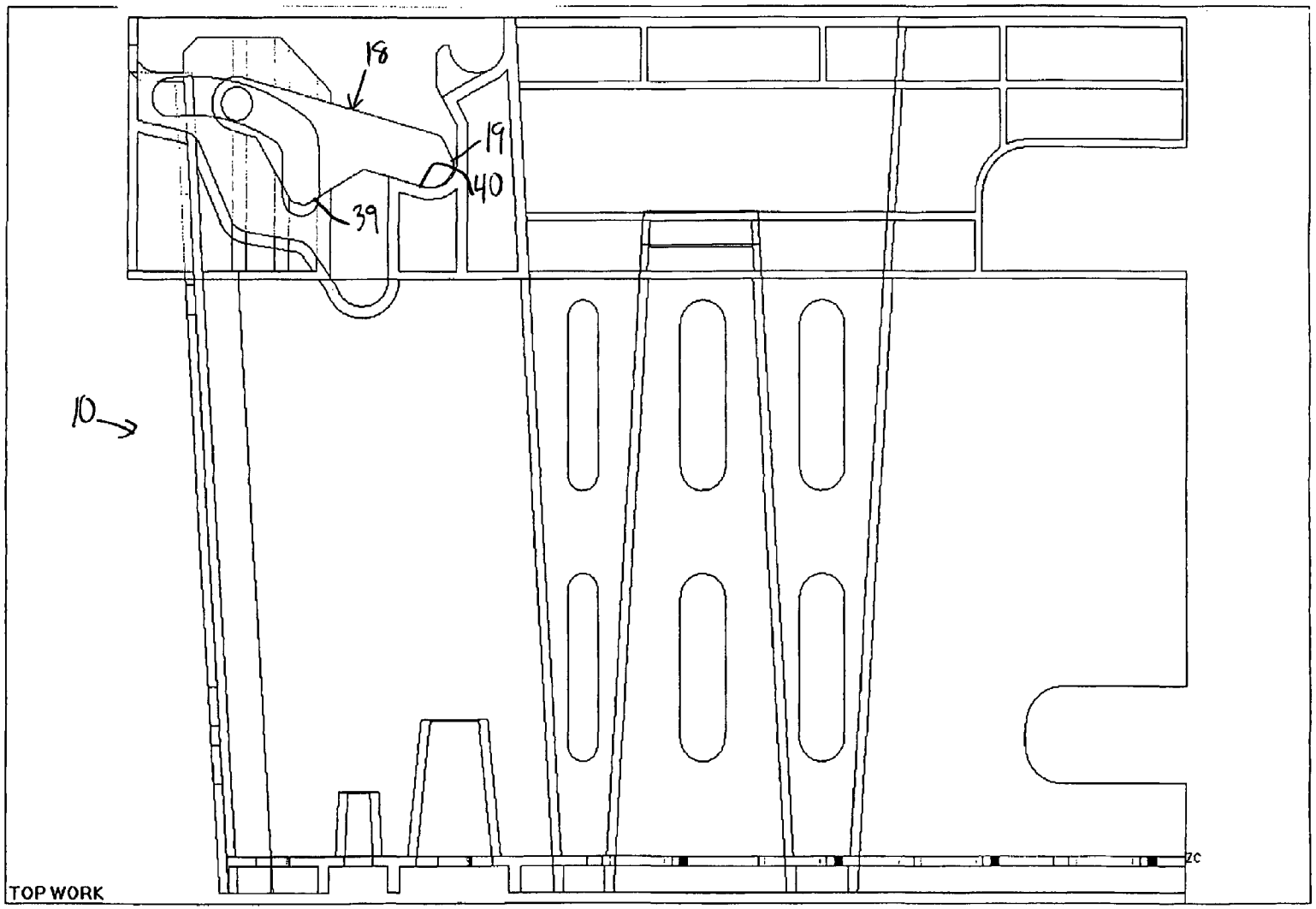
FIG. 8 is a partial side sectional view of the container of FIG. 7.
Figure 9:
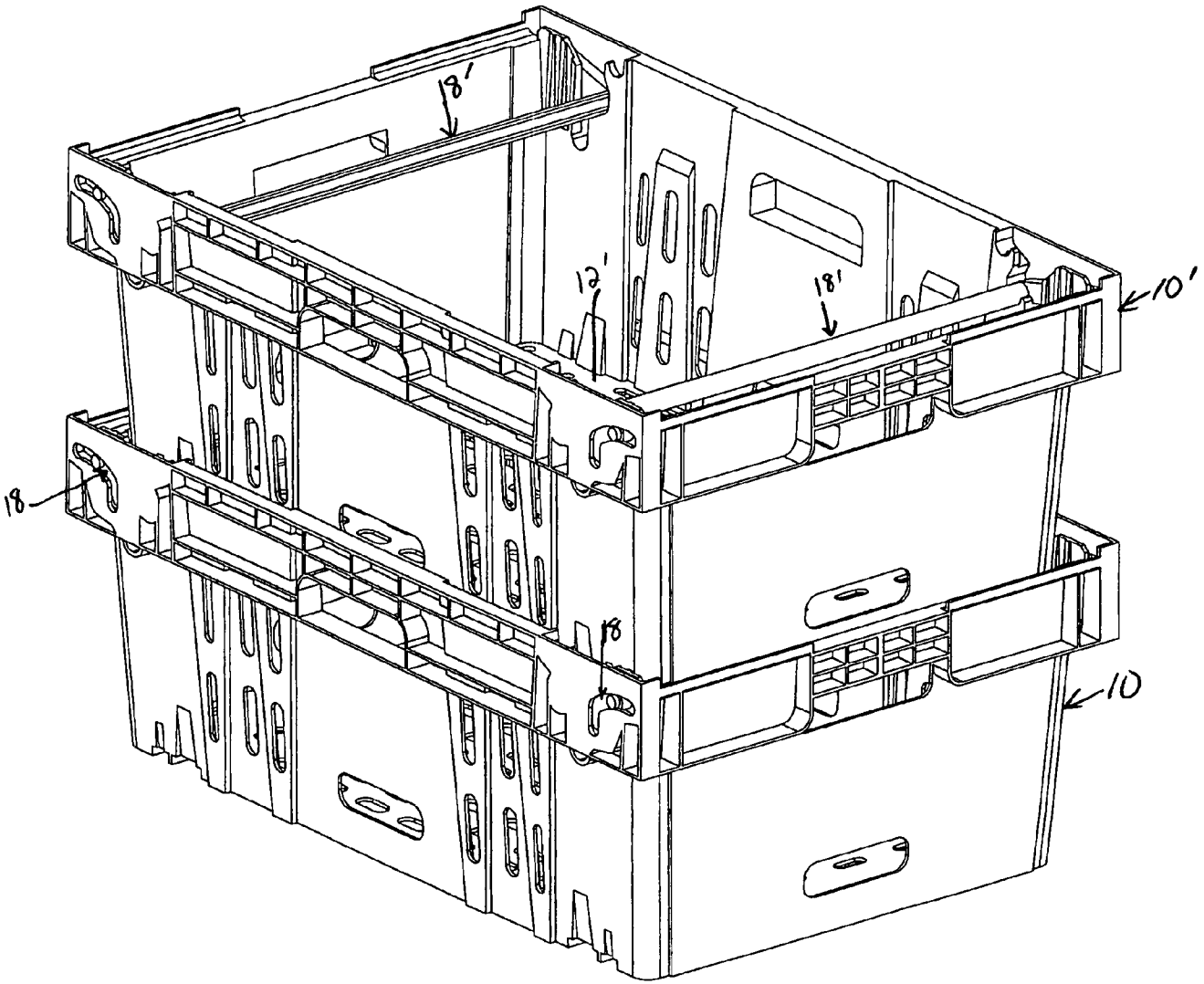
FIG. 9 shows the container of FIG. 7, with a similar container stacked thereon.

FIGS. 7-9 show the container 10 with the bail members in a middle stacking position. The support portions 19 of the bail members 18 are supported by middle rests 40. As shown in FIG. 9, the upper container 10' is supported on the support portions 19 of the bail members 18.

Figure 10:
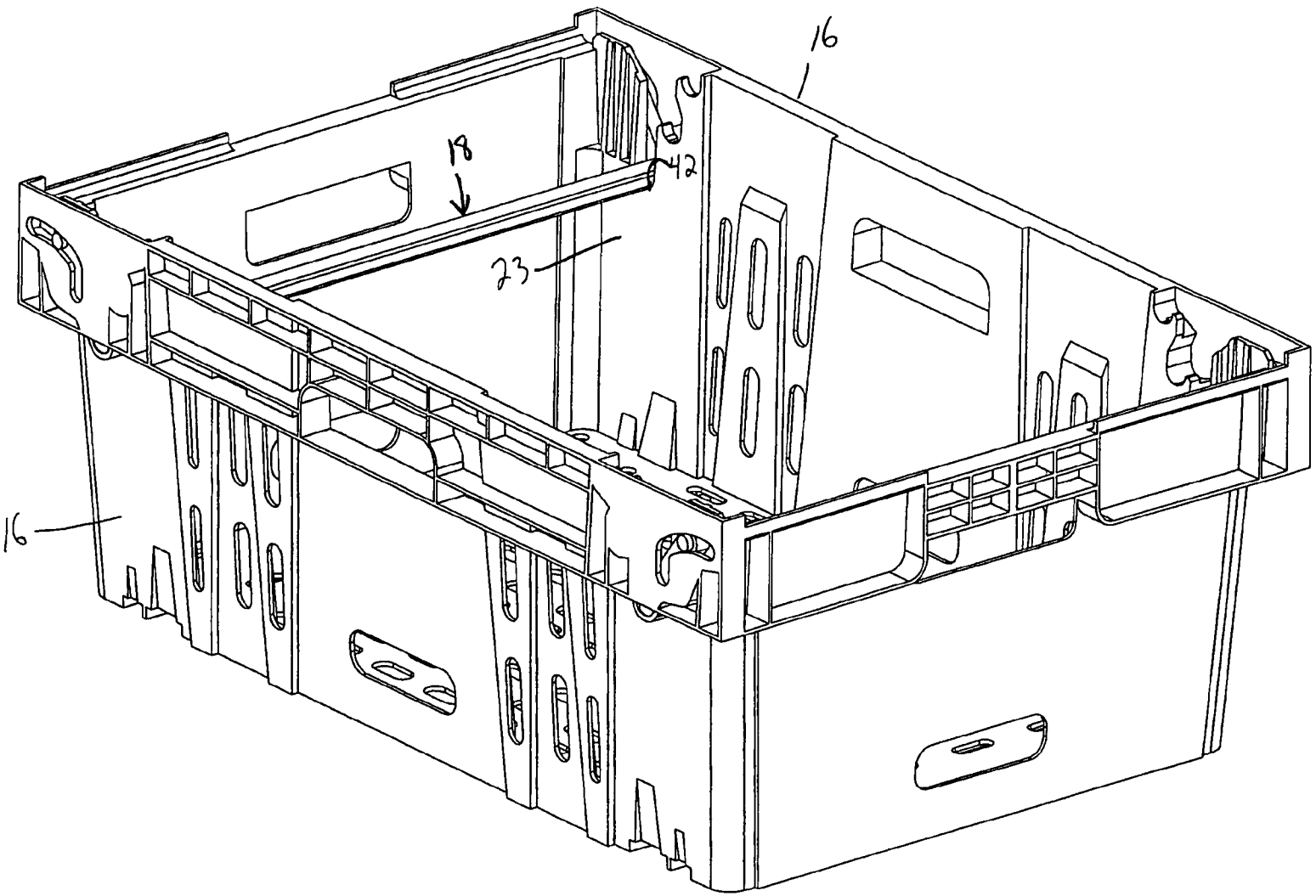
FIG. 10 is a perspective view of the container with the bail members in a low stacking position.
Figure 11:
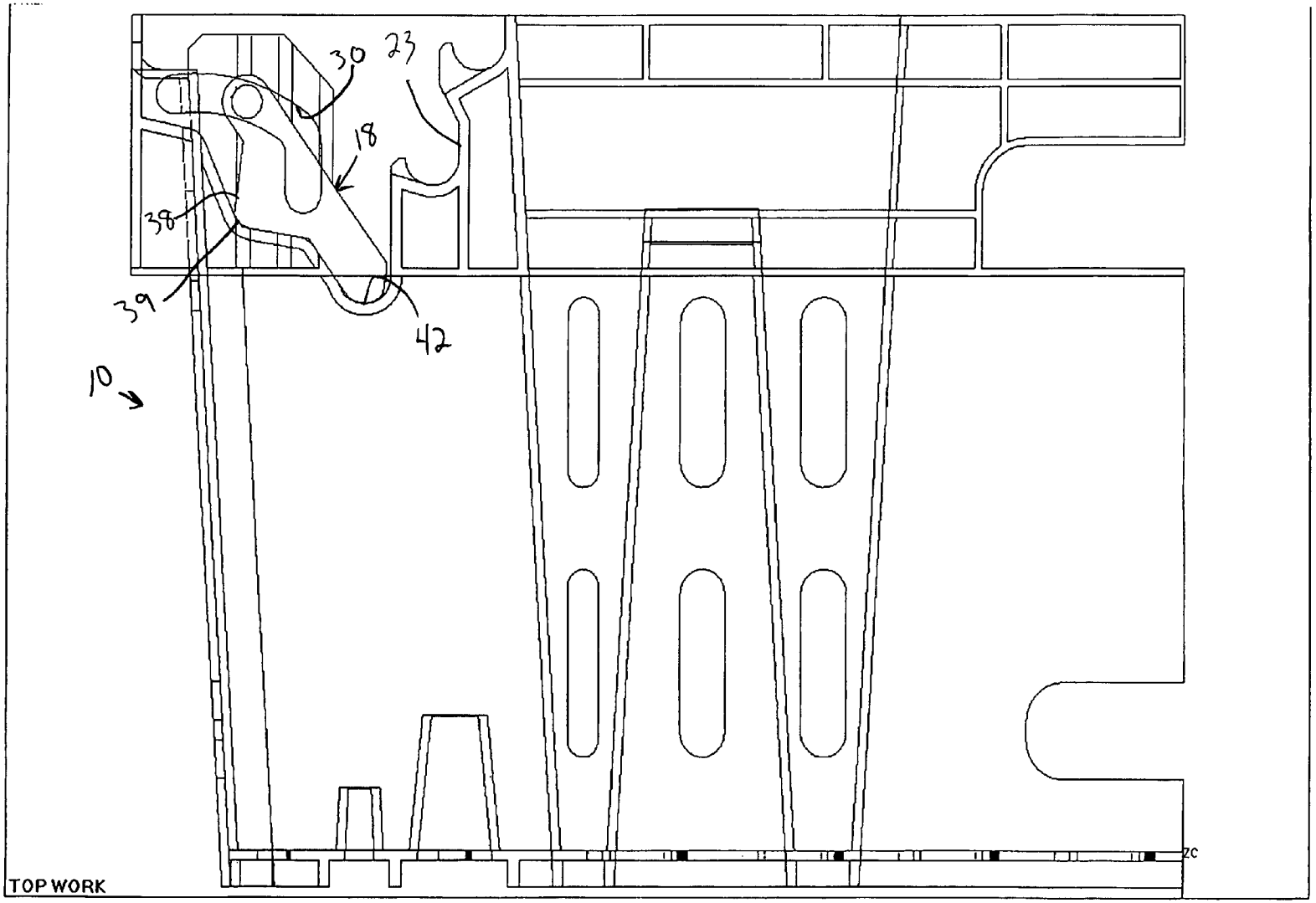
FIG. 11 is a partial side sectional view of the container of FIG. 10.
Figure 12:
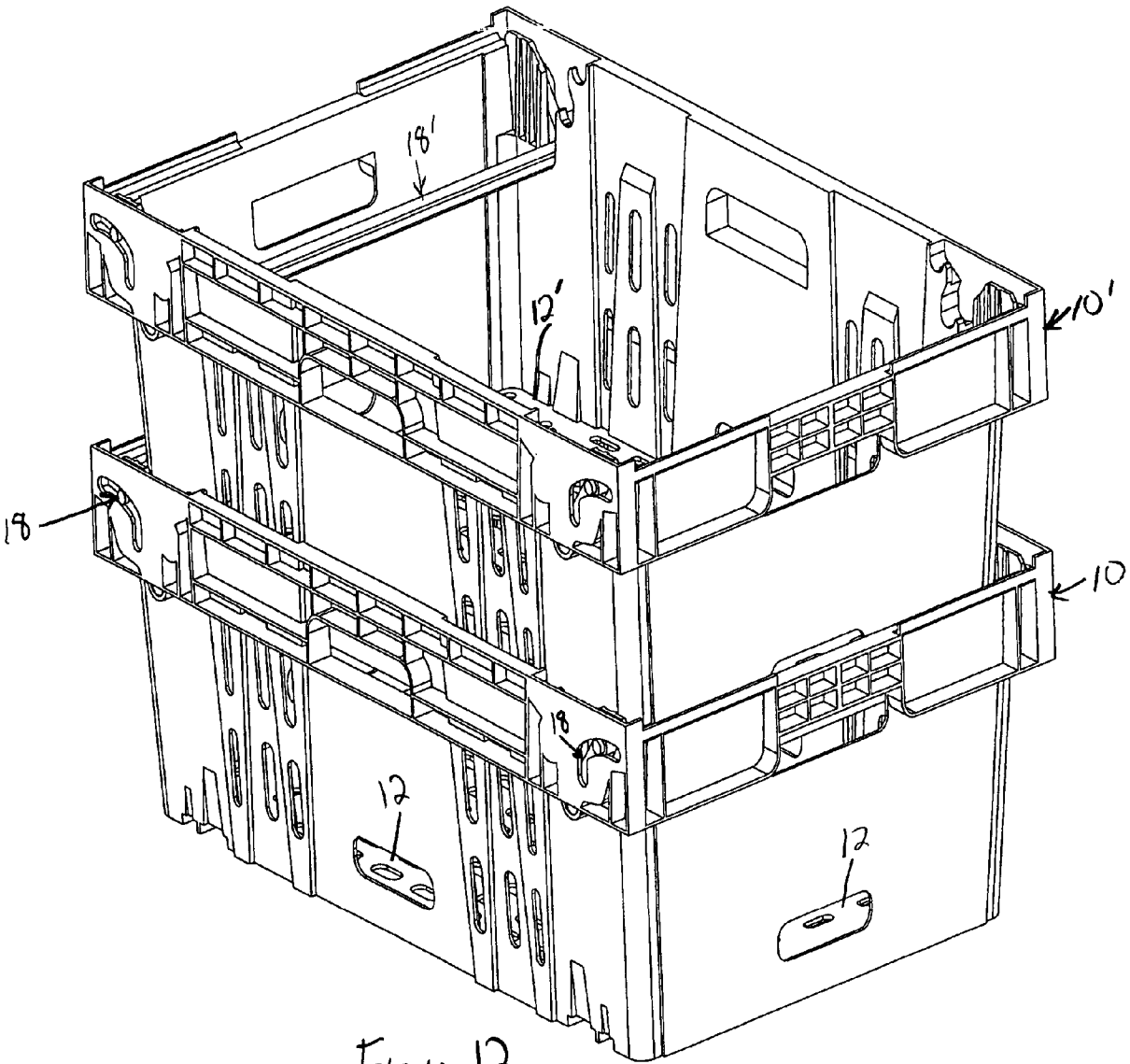
FIG. 12 shows the container of FIG. 10, with a similar container stacked thereon.

FIGS. 10-12 show the bail members 18 in a low stacking position on the lower support rests 42 on the inner wall portions 23. As shown in FIG. 12, the floor 12' of the upper container 10' is supported above the floor 12 by the bail member 18 to create a storage area between the floors 12, 12'.

Figure 13:
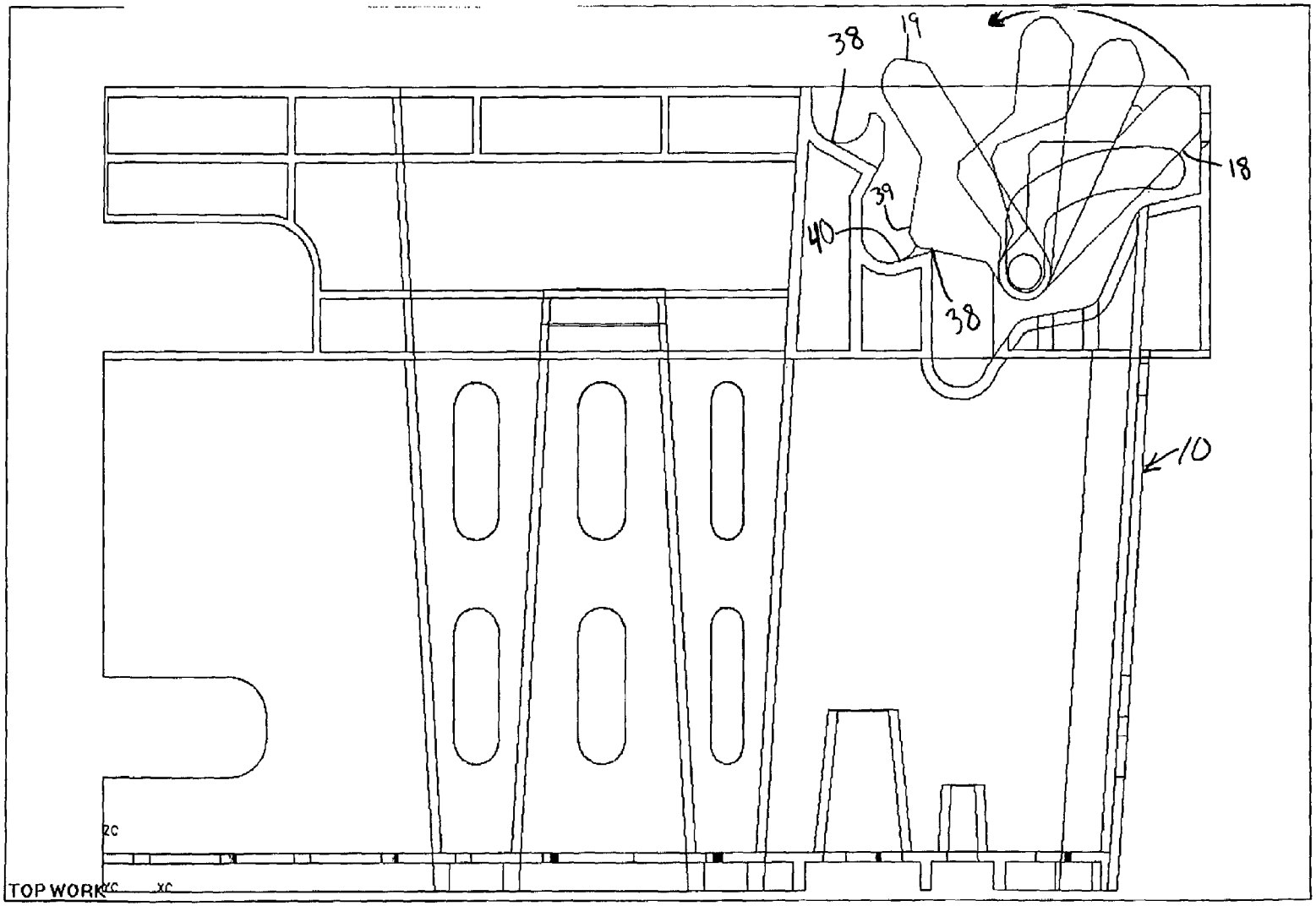
FIG. 13 is an interior side sectional view of the container of FIG. 1 showing the path of the bail member from the nest position toward the high stacking position.

FIG. 13 is an interior side sectional view of the container 10 of FIG. 1 showing the path of the bail member 18 from the nest position toward (but not all the way into) the high stacking position. The bail member 18 pivots about the pin 32 at the lower end of the pin opening 30 until the lateral projection 38 of the arm 21 contacts the middle support rest 40 of the interior wall 23.

Figure 14:
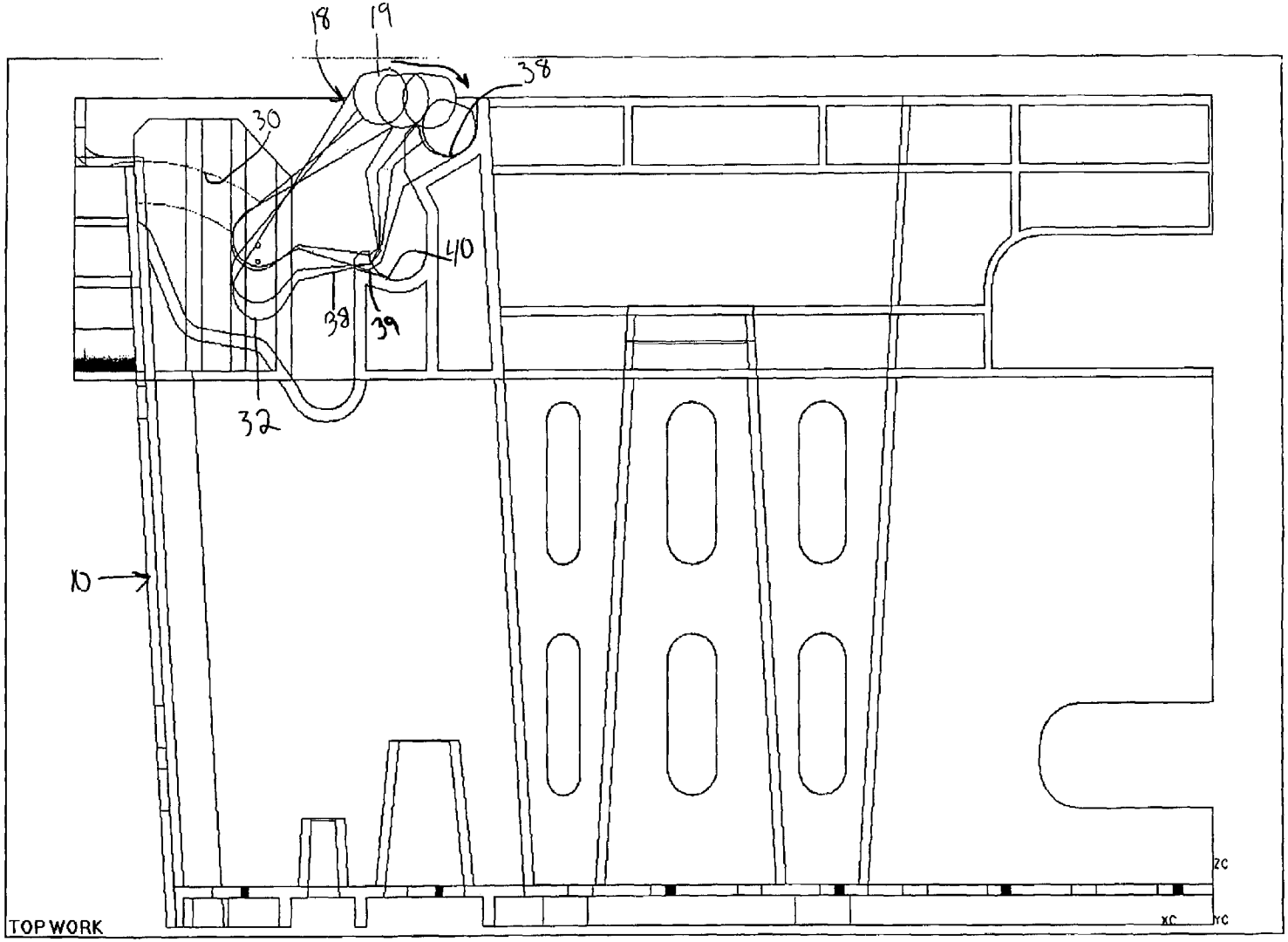
FIG. 14 is a side sectional view of the container of FIG. 1 showing the path of the bail member into the high stacking position.

FIG. 14 is a side sectional view of the container 10 of FIG. 1 showing the path of the bail member 18 from the position shown in FIG. 13 into the high stacking position. As pressure is applied downward and inward onto the support portion 19 of the bail member 18, the lateral projection 38 acts as a fulcrum, pivoting the bail member 18 about the end 39 of the lateral projection 38. As the bail member 18 pivots, the pin 32 rises in the pin opening 30, specifically the vertical portion of the pin opening 30, and the support portion 19 moves in an arcuate path into the upper rest 38.

Figure 15:
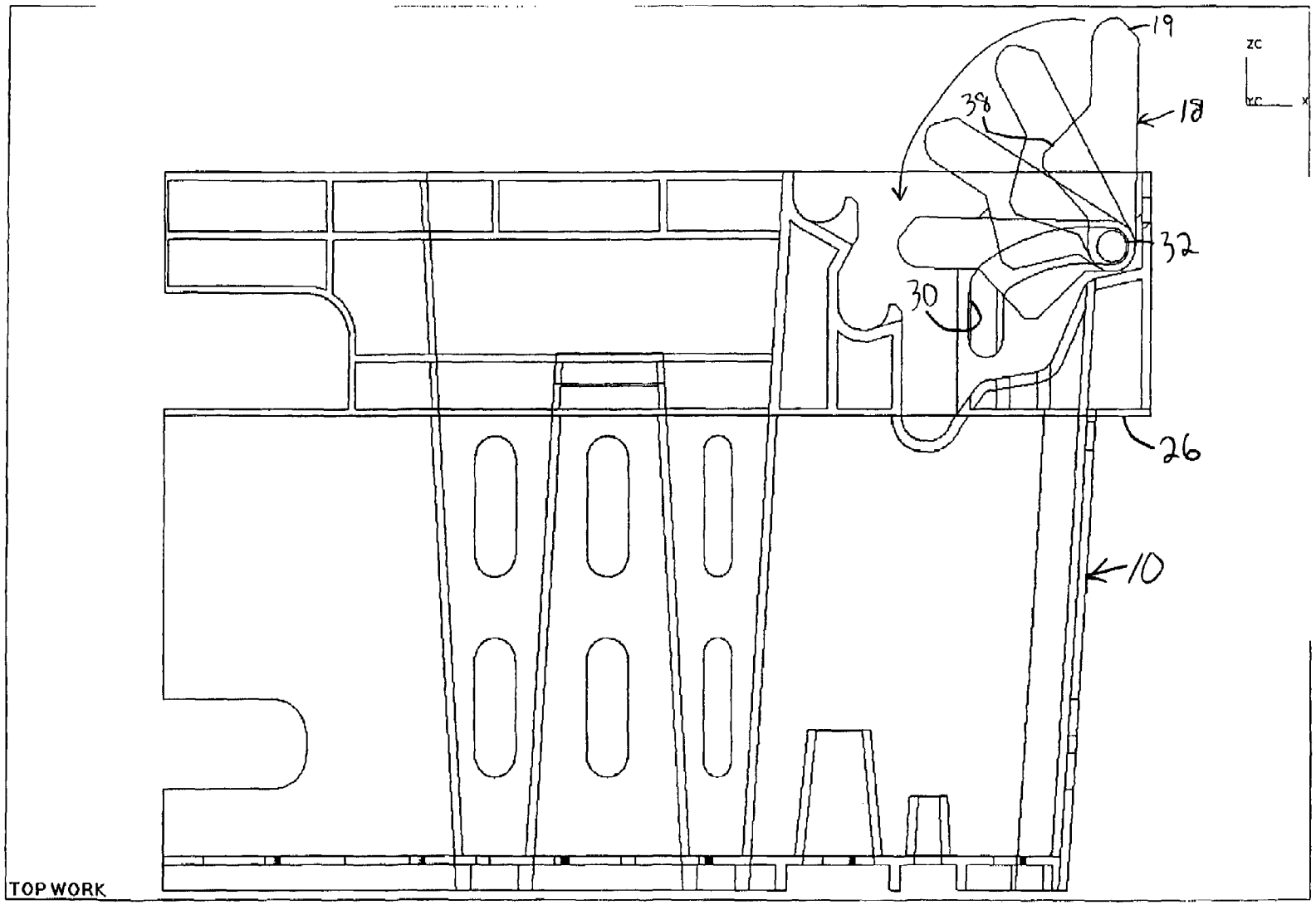
FIG. 15 is an interior side sectional view of the container of FIG. 1 showing the path of the bail member from a high nest position to a transitional position.

FIG. 15 is an interior side sectional view of the container 10 of FIG. 1 showing the path of the bail member 18 from a high nest position to a transitional position. In the high nest position, the support portion 19 and the pin 32 of the bail member 18 are substantially aligned with the outer edge 26 of the side wall 14. The outer edge 26 of a similar container (not shown) would rest on the support portion 19, thus leaving a small space between floors 12, 12'. From the high nest position, the bail member 18 can be pivoted inwardly about the pin 32 at the outermost end of the pin opening 30, until the support portion 19 of the bail member 18 is substantially level with the pin 32. From the transitional position, the bail member 18 can then be moved to either the low stacking position as shown in FIG. 16, or the middle stacking position as shown in FIG. 17.

Figure 16:
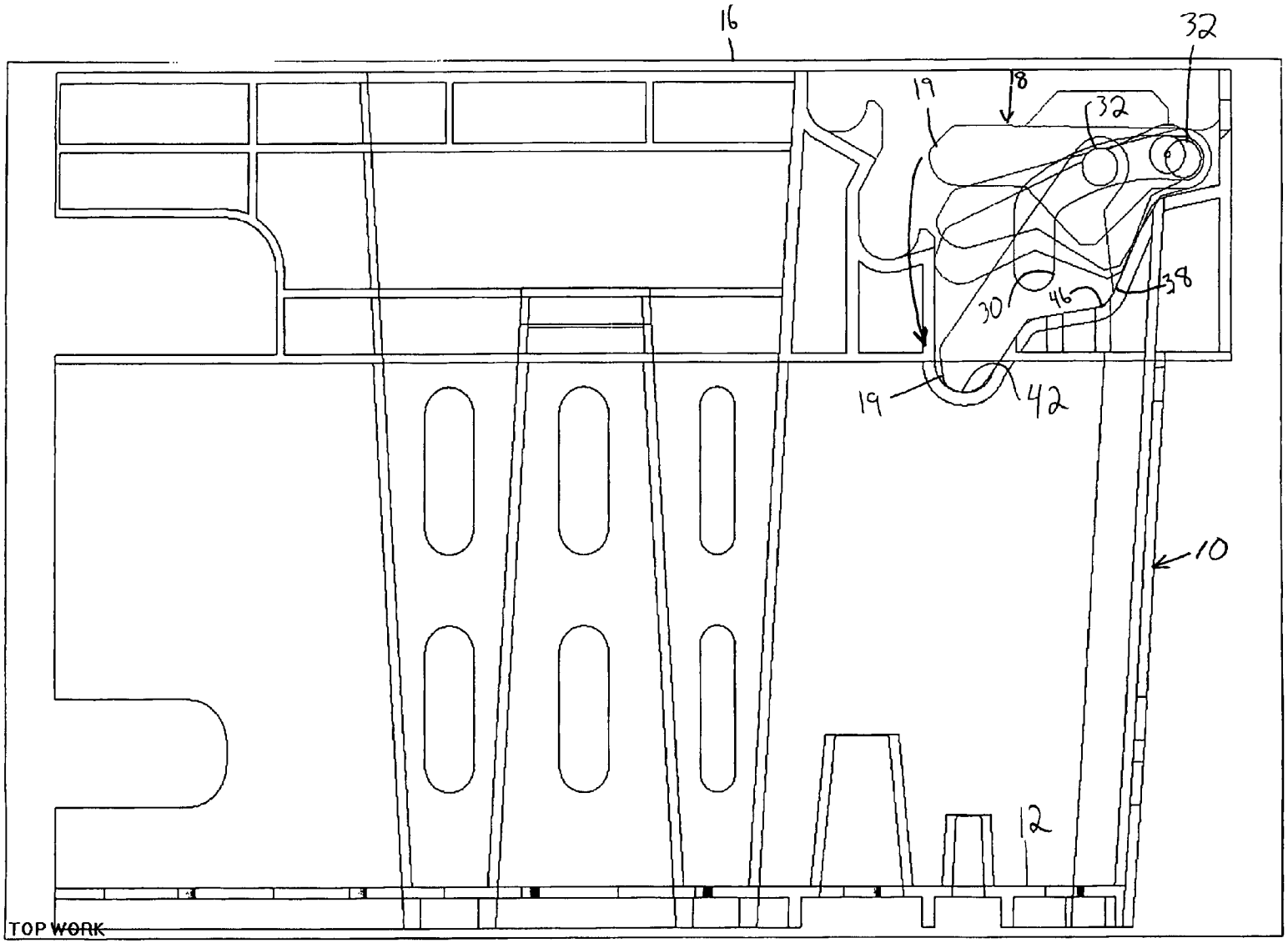
FIG. 16 is an interior side sectional view of the container of FIG. 1 showing the path of the bail member from the transitional position to the low stacking position.

FIG. 16 is an interior side sectional view of the container 10 of FIG. 1 showing the path of the bail member 18 from the transitional position to the low stacking position. The support portion 19 of the bail member 18 is pushed downwardly, thereby pivoting the bail member 18 about the pin 32, which moves inwardly of the container 10 in pin opening 30. Precise movement is not required, as the projection 38 will be received in a recess 46 in the end wall 16. As long as the movement is substantially downward (generally perpendicular to the floor 12), the support portion 19 will be guided into the lower rest 42.

Figure 17:
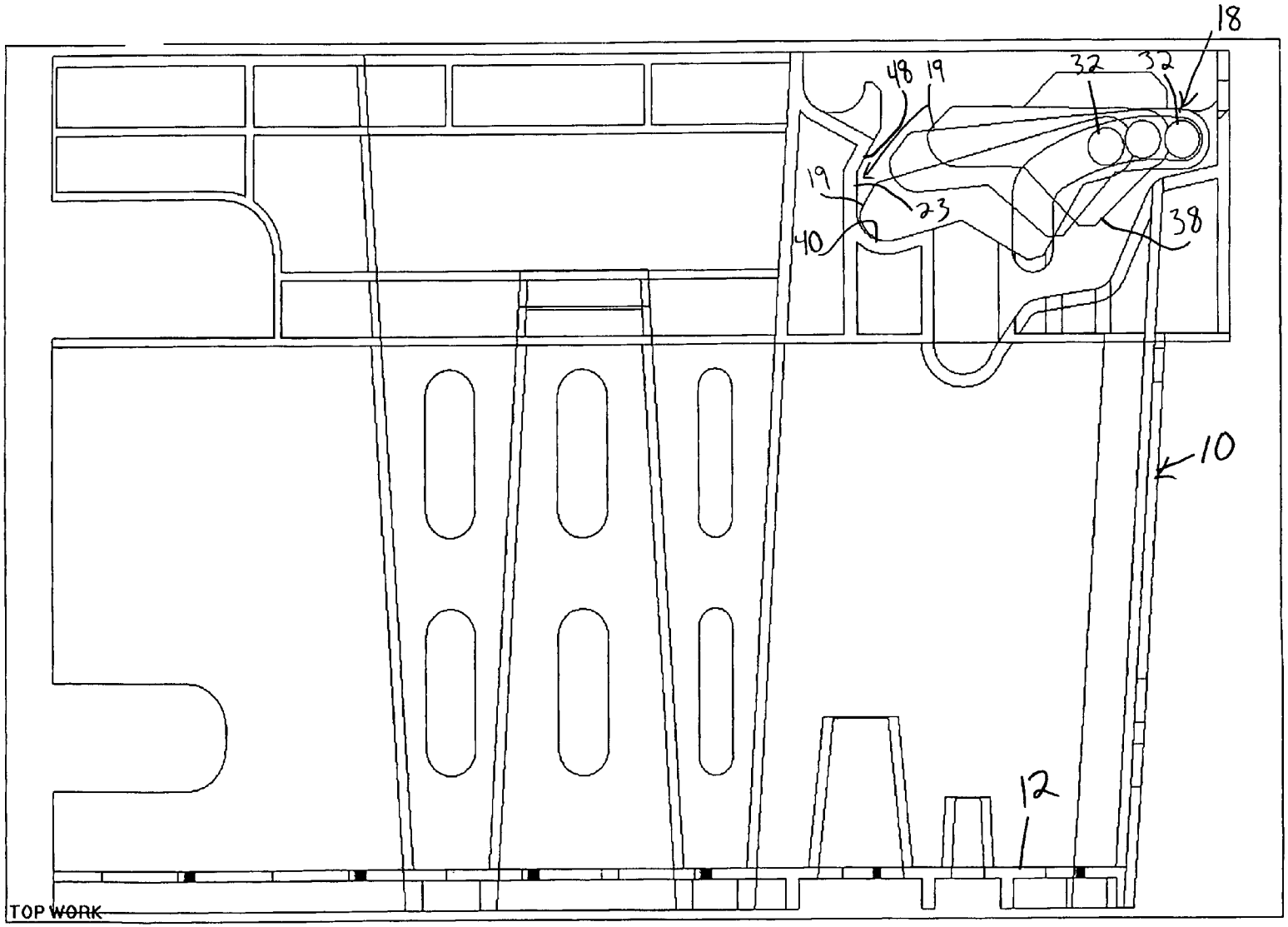
FIG. 17 is an interior side sectional view of the container of FIG. 1 showing the path of the bail member from the transitional position to the middle stacking position.

Alternatively, as shown in FIG. 17, the support portion 19 of the bail member 18 may be pushed inwardly (of the container 10) from the transitional position to the middle stacking position. The pin 32 moves inwardly in the pin opening 30. In the middle stacking position, the support portion 19 is supported on middle rest 40. Again, precise movement is not required. A concave guide surface 48 formed on the inner wall portion 23 between the upper rest 38 and the middle rest 40 will be contacted by the support portion 19 of the bail member 18 and will guide the support portion 19 into the middle rest 40 as long as the movement of the support portion 19 is substantially inward of the container 10, generally parallel to the floor 12.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are different designs of containers that would benefit from the present invention.

What is claimed is:

1. A container capable of supporting a second container in a plurality of positions relative to the container, the container comprising:

a floor;

an upstanding wall structure including a plurality of walls extending upwardly from the floor; and a bail member having a support portion and an arm extending transversely from the support portion, the arm including a projection between opposite axial ends of the arm, the bail member selectively movable between a nest position and a stacking position, the projection contacting a pivot surface of the wall structure while the bail member pivots about an end of the projection and the pivot surface while moving toward one of the nest position and the stacking position.

2. The container of claim 1 wherein the support portion is vertically aligned outwardly of an outer periphery of the floor in the nest position, and the support portion is vertically aligned with the floor in the stacking position.

3. The container of claim 1 wherein the bail member pivots about the end of the projection while moving toward the stacking position.

4. The container of claim 1 wherein the stacking position is a first stacking position and wherein the pivot surface on the wall structure is also a support surface, the support portion of the bail member supported on the support surface of the wall structure when the bail member is moved to a second stacking position.

5. The container of claim 1 wherein the pivot surface on the wall structure is also a support surface, the projection of the bail member supported on the support surface of the wall structure when the bail member is in the first stacking position.

6. The container of claim 5 wherein the stacking position is a first stacking position and wherein the support portion of the bail member supported on the support surface of the wall structure when the bail member is moved to a second stacking position.

7. A container capable of supporting a second container in a plurality of positions relative to the container, the container comprising:

a floor;

an upstanding wall structure including a plurality of walls extending upwardly from the floor; and a bail member having a support portion and an arm extending transversely from the support portion, the bail member selectively movable between a transitional position, a first stacking position and a second stacking position, the arm of the bail extending generally from the support portion of the bail away from an interior of the container when the bail member is in the transitional position, the bail member movable from the transitional position to the first stacking position by moving the bail member inwardly, the bail member movable from the transitional position to the second stacking position by pivoting the bail member, wherein the bail member will move from the transitional position to the second stacking position based upon a force applied to the support portion in a second direction entirely downwardly of the container toward the floor.

8. The container of claim 7 wherein the arm includes a lateral projection between opposite axial ends of the arm.

9. The container of claim 7 wherein the bail member includes a pin slidable and rotatable in an opening on the wall structure, the opening including a first portion that extends from an outer end inwardly and downwardly and a second portion extending from the first portion downwardly to an inner end.

10. The container of claim 9 wherein the pin extends from the arm of the bail member and wherein the pin and the support portion are substantially at equal heights above the floor when the bail member is in the transitional position.

11. The container of claim 7 wherein the bail member will move from the transitional position to the first stacking position based upon a force applied to the support portion in a first direction entirely inward of the container parallel to the floor.

12. A container capable of supporting a second container in a plurality of positions relative to the container, the container comprising:

a floor;

an upstanding wall structure including a plurality of walls extending upwardly from the floor, the wall structure including a first rest and a second rest, the first rest spaced from the floor by a greater distance than the second rest is spaced from the floor; and a bail member having a support portion and an arm extending from the support portion, the arm including a radial projection between opposite axial ends of the arm, the bail member selectively movable between a nest position, a first stacking position and a second stacking position, the support portion supported on the first rest and the projection supported on the second rest when the bail member is in the first stacking position, the support portion supported on the second rest when the bail member is in the second stacking position.

13. The container of claim 12 wherein the bail member further includes a pin extending from the arm, the pin slidably and rotatably coupled to the wall structure.

* * * * *

UNITED STATES PATENT AND TRADEMARK OFFICE

CERTIFICATE OF CORRECTION

PATENT NO. : 7,581,641 B2
APPLICATION NO. : 11/109485
DATED : September 1, 2009
INVENTOR(S) : Hassell et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 630 days.

Signed and Sealed this

Fourteenth Day of September, 2010

David J. Kappos

David J. Kappos
*Director of the United States Patent and Trademark Office*